US007181032B2

(12) United States Patent
Jakob et al.

(10) Patent No.: US 7,181,032 B2
(45) Date of Patent: Feb. 20, 2007

(54) METHOD FOR ESTABLISHING A DETACHABLE MECHANICAL AND/OR ELECTRICAL CONNECTION

(75) Inventors: Andreas Jakob, Hombrechtikon (CH); Herbert Baechler, Meilen (CH)

(73) Assignee: Phonak AG, Stafa (CH)

( * ) Notice: Subject to any disclaimer, the term of this patent is extended or adjusted under 35 U.S.C. 154(b) by 852 days.

(21) Appl. No.: 09/804,848

(22) Filed: Mar. 13, 2001

(65) Prior Publication Data

US 2002/0131614 A1 Sep. 19, 2002

(51) Int. Cl.
*H04R 25/00* (2006.01)

(52) U.S. Cl. ..... 381/314; 381/323

(58) Field of Classification Search ..... 381/314, 381/312, 315, 322, 323, 331, 174, 191, 316, 381/326; 600/25; 607/56–57
See application file for complete search history.

(56) References Cited

U.S. PATENT DOCUMENTS

| | | | | |
|---|---|---|---|---|
| 3,629,521 | A * | 12/1971 | Puharich | 381/326 |
| 4,025,964 | A | 5/1977 | Owens | |
| 4,679,240 | A | 7/1987 | Heide | |
| 4,756,312 | A | 7/1988 | Epley | |
| 5,341,433 | A | 8/1994 | Meyer | |
| 5,359,321 | A | 10/1994 | Ribic | |
| 5,545,191 | A * | 8/1996 | Mann et al. | 607/57 |
| 5,553,152 | A | 9/1996 | Newton | |
| 5,708,720 | A | 1/1998 | Meyer | |
| 6,157,728 | A * | 12/2000 | Tong et al. | 381/331 |
| 6,381,336 | B1 * | 4/2002 | Lesinski et al. | 381/326 |
| 6,597,320 | B2 * | 7/2003 | Maeda et al. | 343/718 |
| 2002/0015506 | A1 * | 2/2002 | Aceti et al. | 381/314 |
| 2002/0030630 | A1 * | 3/2002 | Maeda et al. | 343/702 |

FOREIGN PATENT DOCUMENTS

| | | |
|---|---|---|
| EP | 0289208 | 11/1988 |
| FR | 2 728 106 | 12/1994 |
| FR | 2728106 | 6/1996 |
| FR | 2 751 161 A | 1/1998 |
| GB | 1 259 517 | 1/1972 |
| JP | 2000-353571 | 12/2000 |
| JP | 2001-320516 | 12/2000 |
| WO | 91/04644 | 4/1991 |
| WO | WO92/22107 | 12/1992 |
| WO | WO97/05673 | 2/1997 |

OTHER PUBLICATIONS

Derwent Abstracts: pat JP2001-320516 (Pub. Dt.: Dec. 19, 2000).
Derwent Abstract: pat FR1996-302970 (Pub. Dt.: Jun. 14, 1996).
Translation of pat JP2001-320516 (Pub. Dt.: Dec. 19, 2000).
Translation of pat FR1996-302970 (Pub. Dt.: Jun. 14, 1996).

* cited by examiner

*Primary Examiner*—Suhan Ni
(74) *Attorney, Agent, or Firm*—Pearne & Gordon LLP

(57) ABSTRACT

An electrical connection to or in a hearing apparatus is established by assembling a series capacitor. The capacitor is formed by one part having one capacitor plate and a second part having another capacitor plate. A part of the casing of the hearing apparatus can be used as a dielectricum of the capacitor.

18 Claims, 5 Drawing Sheets

METHOD FOR ESTABLISHING A DETACHABLE MECHANICAL AND/OR ELECTRICAL CONNECTION

BACKGROUND OF THE INVENTION

The present invention is generically directed to mechanical links between modules of a hearing aid apparatus, so as to construe the hearing aid apparatus or between a hearing aid apparatus and an additional appliance.

It is further directed to a technique for establishing an electrical connection, again either between modules concomitantly defining the hearing aid apparatus or between a hearing aid apparatus and an additional appliance.

It is known from the U.S. Pat. No. 6,157,728 to transmit electrical signals to a therapeutical outside-the-ear hearing aid apparatus via an inductive link. In the transmission cable as an additional appliance to the hearing aid apparatus there is provided an induction coil wound around a cylindrical magnet. The axis of the cylindrical magnet is perpendicular to a surface along which the cable's plug is applied to the hearing aid apparatus. Within the hearing aid apparatus there is provided a disk-shaped ferromagnetic plate adjacent to the respective surface of the hearing aid apparatus, to which the plug is to be joined. The cylindrical magnet, on the one hand, and the disk-shaped ferromagnetic plate, on the other hand, simultaneously form the mechanical link between the appliance and the hearing aid apparatus and the electrical inductive connection between the appliance and electronic components within the hearing aid apparatus.

Thereby, analogue signals as audio signals are transmitted between the inductive link of induction coil with cylindrical magnet core on the side of the appliance and ferromagnetic plate as receiver part on the side of the hearing aid apparatus.

Although being advantageous with respect to easy mechanical linking of the appliance to the hearing aid apparatus by the user carrying the hearing aid apparatus at his ear, this technique suffers different drawbacks:

- Due to the arrangement of the ferromagnetic plate perpendicularly to the axis of the cylindrical magnet, once the appliance is mounted to the hearing aid apparatus, this ferromagnetic plate considerably shunts and thus dampens in particular high frequency signals to be transmitted.
- Due to the fact that the ferromagnetic plate has two objects, namely contributing to the mechanical link as well as contributing to the electric signal transmission, a compromise solution as with respect to the material of the ferromagnetic plate on the one hand for signal transmission, on the other hand for mechanical linkage purposes must be made, which may not be optimum for both objects.
- Due to the inductive link, whereat parts, namely the ferromagnetic plates, are used for both objects, namely mechanical and electrical link, there is an interdependency between mechanical and electrical link quality, which, as was said, may not be construed optimally for both purposes.

BRIEF SUMMARY OF THE INVENTION

It is an object of the present invention to remedy for the above mentioned drawbacks of the prior art technique as mentioned as concerns mechanical links and as concerns electrical links, and further as concerns combined electrical and mechanical links. Thereby, the principal advantage of easily handable as realized by the prior art teaching shall be maintained.

With respect to mechanical linking, this target is reached according to the present invention by the method for establishing a detachable mechanical link at a hearing aid apparatus by establishing an exclusively mechanical link magnetically.

Thereby, the high advantage of easily establishing such a link by the user is maintained, but functionally the magnetical link per se does not contribute or affect any electrical link.

In a preferred embodiment of the invention the magnetical link is established between at least two modules of the hearing aid apparatus, which-concomitantly define the hearing aid apparatus or to a hearing aid apparatus and an additional appliance.

Although inventively, the mechanical link which is established magnetically does not form part of an electrical link in the sense of not affecting the quality of the electrical link, in a preferred embodiment of the present inventive method by establishing the mechanical link there is established an electrical connection, but separate from the mechanical link.

In a further preferred embodiment the attracting force of the magnetical link is exploited to establish a predetermined relative positioning of the parts by establishing the mechanical link.

In a further preferred embodiment and again exploiting polarity of a magnetic linkage, the mechanical link is enabled or disabled by appropriately selecting polarity direction of at least two magnets for the mechanical linking. If the inventive mechanical link is to be realized by two magnets, one magnet on each part to be linked, then mutual polarity directions of these magnets will automatically control, whether the two parts may be mechanically linked or not. In one mutual polarity distribution the magnets will be mutually attracted, thereby enabling the mechanical link, in the other they will be magnetically separated, thereby disabling such mechanical link.

In a further preferred embodiment the mechanical link is established on the one hand to a part of the hearing aid apparatus, which comprises the signal processing modules and on the other hand at least one of the following parts:

- a battery or accumulator module
- an emitter and/or receiver module
- a filter module
- a microphone module
- an optical or an electrical cable.

In a first preferred mode of the inventive method, whereat, as was mentioned above, by means of establishing the mechanical link there is established separate therefrom an electrical connection, it is proposed to establish as an electrical link a galvanic electrical connection. This may e.g. be realized in that by establishing the mechanical link magnetically a pair or more than one pair of electrical contacts are established.

As was mentioned above, the mere fact that an inductive link between two parts to be electrically connected from or at a hearing aid apparatus prevents optimum exploitation of establishing the mechanical link magnetically, which on the other hand has high advantages with respect to easy establishment by the user. Additionally, and as may be seen e.g. from the above mentioned U.S. Pat. No. 6,157,728, an inductive link necessitates at least on one of the two parts a coil/magnet arrangement, which obstructs quite a part of volume, which is for any hearing aid appliance always of high disadvantage. Also in view of this additional disadvantage it is inventively proposed a method for establishing an electrical connection to or in a hearing aid apparatus by establishing the electrical connection via a series capacitor, thereby exploiting a part of the hearing apparatus' casing as the dielectricum of the capacitor.

This approach to electrical connection enables realization of an additional mechanical link magnetically, as was discussed above and without that requirement for the mechanical link would interfere with the requirements for the electrical connection. Therefore, in a preferred realization form, the capacitive electric link technique is combined with the inventive magnetic/mechanical link technique as was explained above.

In a preferred form of the latter technique, there is established the electrical connection between an electrical cable and an electric tab at the casing of the hearing aid apparatus, thereby exploiting a part of the casing as the dielectricum of the series capacitor.

In a further preferred mode of realization the connection is established to a one-lead electric cable and the electronic circuitry within the hearing aid is operationally connected on the one hand capacitively to said one-lead electric cable, and on the other hand to a body contact electrode, the electric potential of this body contact electrode being exploited as said electronic circuitry as a reference potential. In other words, the electronic circuitry of the hearing aid apparatus is driven on the potential of the user's body, which body performs closure of an electrical current loop from said one-lead electric cable to the electronic circuitry back to the source of signals transmitted to the electronic circuitry.

In a further preferred embodiment the hearing aid apparatus is an in-the-ear hearing aid apparatus or an outside-the-ear hearing aid apparatus, both for impaired hearing individuals or for not hearing impaired individuals just as a hearing aid, or is an earphone apparatus.

The cable, especially the one-lead electric cable, is in a preferred further embodiment a connecting cable to a transmitter module remote from the hearing aid apparatus or a linking cable to a programming unit for programming the hearing aid apparatus. Such a transmitter module may be realized by a Bluetooth converter or by an external player as a minidisk player, and MP3 player, a CD player etc.

In a further preferred embodiment the said cable forms at least a part of a binaural link from one hearing aid apparatus to a second one.

In a highly preferred mode of operation digital signals are led through said series capacitor as especially digitally controlled signal traits.

To fulfill the above mentioned object there is further proposed a hearing aid apparatus comprising at least two releasable modules as the at least two linkable parts with mechanical linking members or with an additional appliance as one linking part removably linkable to the hearing aid apparatus as a second linking part by mechanical linking members, wherein the mechanical linking members comprise at least one magnet.

In a preferred embodiment there is provided, in the area of the mechanical link to be established at at least one of the linking parts, a magnet arrangement, preferably a permanent magnet arrangement, and there is further provided, at the other of said linking parts, as was mentioned, a magnet arrangement as well or a counterpart of ferromagnetic material. In a further preferred embodiment of the inventive hearing aid apparatus the mechanical linking members are the mechanical linking members for an electrical connection.

In a further preferred mode of realization the mechanical linking members comprise guiding members, which ensure establishment of the mechanical link in a predetermined mutual position of the linkable parts.

In a further preferred embodiment one part to be linked comprises a signal processing module, and the other part is one of the following parts:

a battery or accumulator module a transmitter and/or receiver module a filter module a microphone module an optical or an electrical cable.

In a further preferred embodiment the mechanical linking members are the mechanical linking members of an electrical galvanic connection between the parts.

There is further proposed an inventive hearing aid apparatus, still to resolve the problems discussed in connection with the inventive method, with a detachable electric connection, wherein the electrical connection comprises a series capacitance, a part of a casing of the hearing aid apparatus forming the dielectricum of the capacitance.

Thereby, again preferred, the mechanical link for such electrical connection is construed magnetically, as was discussed above.

In a further preferred embodiment of the inventive hearing aid apparatus the one part to be electrically connected is the hearing aid apparatus, another part is a preferably one-lead connecting cable.

BRIEF DESCRIPTION OF THE SEVERAL VIEWS OF THE DRAWINGS

Further preferably, the hearing aid apparatus comprises a body-contacting electrode which is exposed to ambient. This electrode, in use of the hearing aid apparatus, contacts the human body, and electrical potential of this electrode is exploited as the reference potential for the electronics of the hearing aid apparatus, i.e. as ground potential.

The present invention shall now be described by way or examples as shown in the following figures. These figures show.

DETAILED DESCRIPTION OF THE INVENTION

Figure 1:
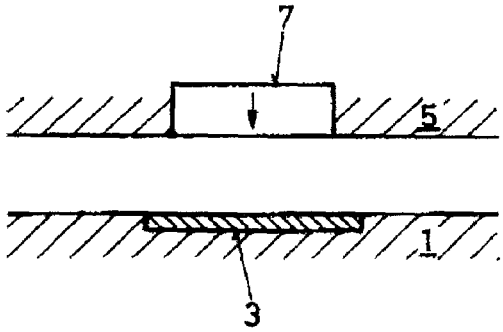
FIG. 1 schematically, the principal of the inventive mechanical linking method as is provided at a hearing aid apparatus according to the present invention.

In FIG. 1 there is schematically shown the principle of the inventive mechanical linking. On a first part 1 to be mechanically linked, be it a hearing aid apparatus or one module of a hearing aid apparatus, there is provided a pole piece 3 of ferromagnetic material. At the second part 5 to be mechanically linked to the part 1, be it an appliance to be removably linked to the hearing aid apparatus or be it a module to concomitantly form a hearing aid apparatus together with part 1, a magnet arrangement 7, preferably a permanent magnet arrangement, is provided.

Obviously, instead of providing a pole piece 3 in fact magnetically passive at one of the two parts, it is absolutely possible to provide at both parts 1 and 5 an active magnet arrangement, again preferably of permanent magnets.

Figure 2:
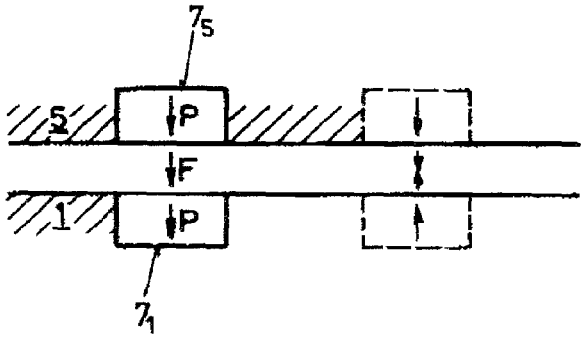
FIG. 2 in a representation form in analogy to that of FIG. 1, a further embodiment of the inventive magneto/mechanical linking technique at a further embodiment of a hearing aid according to the present invention.

According to FIG. 2, this embodiment is shown in that both parts to be mechanically linked 1 and 5 comprise both magnet arrangements $\mathbf{7}_5$ and $\mathbf{7}_1$ respectively. This technique allows to prevent establishment of mechanical links between parts or in positions of parts which shall not be mechanically linked. As may be seen in FIG. 2, if the polarities P of the magnet arrangement, again preferably of permanent magnets, are the same, then the two parts 1 and 5 will be attracted by the mutual magnetic force F, thereby leading to the magnetical link as desired. Whenever the polarities of the two magnet arrangements are inversed as shown in dashed lines, then approaching the two parts 1 and 5 to be mechanically linked will be prevented by the repelling force of the magnets.

Whenever a magneto-mechanical link is established between the parts to be linked as was shown in FIGS. 1 and 2, such a mechanical link may be established, even if the two parts are laterally and mutually slightly shifted, so that an exact positioning of the two parts at the desired mutual position may be not accurate and not accurately reproducible.

Figure 3:
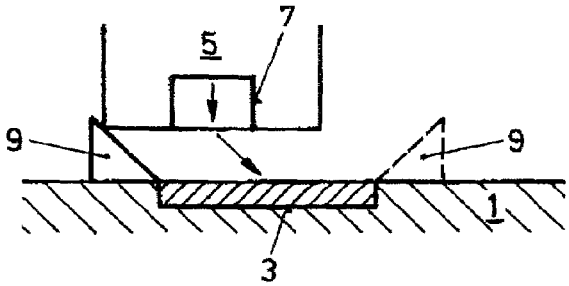
FIG. 3 still in a schematic representation according to the FIGS. 1 and 2, a further improvement of the inventive mechanical linking technique for accurately positioning the parts to be linked as realized at one embodiment of a hearing aid apparatus according to the present invention.

Therefore, and as schematically shown in FIG. 3, the attracting magnetic force is generically exploited to draw the two parts to be linked in an exact mutual position.

Therefore, and as schematically shown in FIG. 3, there are provided at one or at both of the parts 1 and 5 to be linked mutually co-operating guiding members 9, which automatically lead the two parts 1 and 5 to be mechanically linked in an accurately defined mutual position by exploiting the attracting force of the magnet arrangement 7.

Figure 4:
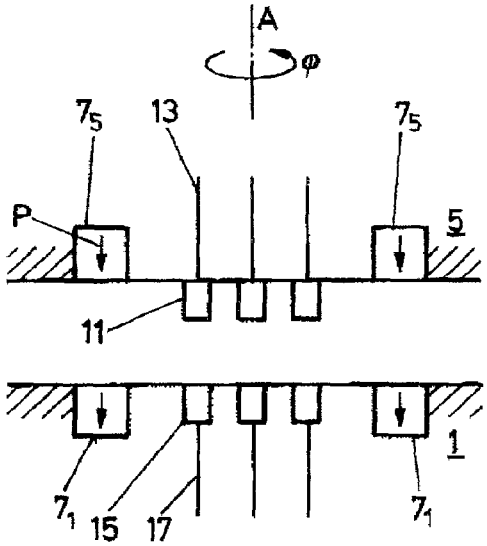
FIG. 4 still in a representation in the schematic form according to the FIGS. 1 to 3, realization of the inventive mechanical linking method together with galvanic electrical linking as realized in a hearing aid apparatus according to the invention.

As was mentioned above the inventively provided magneto/mechanical link shall not interfere especially as concerns selection of the material used for establishing the magnetic link on the one hand and the electric link on the other, but as again schematically shown in FIG. 4, the magneto/electrical link according to the present invention may clearly be used for mechanically holding parts together which are electrically linked.

According to FIG. 4, e.g. at part 5 with the magnet arrangement $\mathbf{7}_5$ one or more than one electric connection pin 11 may be provided as electric contact connected within part 5 to respective electric leads 13. At part 1 there is provided the magnet arrangement $\mathbf{7}_1$, again preferably of permanent magnets, and the female counterparts 15 for the pins 11 to establish respective electrical galvanic connections. The female plugs 15 are connected to electrical leads 17. By mechanically linking the two parts 1 and 5 there is established a galvanic electrical connection of the contacting parts 11 and 15 without the magnet arrangements at the respective part interfering or affecting such electrical connection.

It has to be noted that by appropriately selecting the polarities P of the magnet arrangement at the two parts 1 and 5, one can control in which position the two parts have to be linked. If the magnet arrangements are e.g. formed by respective permanent magnets distributed in an annular pattern around a central axis A by appropriately selecting the polarities of the magnets, it may be predetermined at which mutual angle position $\phi$ the two parts 1 and 5 may be magneto/mechanically linked, thereby defining for the proper positioning of the electric contact parts 11 and 15 to be connected as desired.

Further, the technique of additionally establishing an electric connection as of FIG. 4 may be clearly be combined with the positioning technique as schematically shown in FIG. 3 so as to establish proper mutual positioning for installing proper and correct electrical connections.

In FIG. 5A there is again schematically shown the principle of establishing an electric connection according to the present invention. A hearing aid apparatus or a module thereof 21 comprises a shell or casing 23, wherein electronic units, as e.g. a digital signal processing unit 27 is mounted.

A second part 25, as e.g. a second module forming together with module according to part 21 the hearing aid apparatus or being an appliance to be applied to the hearing aid apparatus part 21 comprises a first capacitance electrode $\mathbf{30}_a$, which is metallic and which, not necessarily but preferably, has a metallic surface 32 exposed to ambient.

In the casing 23 of the second part 21 to be electrically linked to part 25, there is provided a metallic electrode $\mathbf{30}_b$ being separate from the ambient U by a part $\mathbf{23}_d$ of casing 23 being of a dielectric material, as of plastic material of the casing 23. The electrode $\mathbf{30}_b$ is electrically connected to the unit 27. When the two parts 25 and 21 are brought together there results a series capacitance formed by electrode $\mathbf{30}_a$, dielectricum $\mathbf{23}_d$ and second electrode $\mathbf{30}_b$. This capacitance C acts as series signal-transmitting element between the two parts 25 and 21. It goes without saying that the dielectric covering may also be applied to the surface 32 of electrode 30*a* or exclusively to that surface.

The electronic unit 27 within the hearing aid module 21 gets its reference potential from a body-contacting electrode 35. When applied to the human body, the electrode 35 assumes the local electric potential $\phi_a$ of the body via electrolytic contact, which may be improved by electrolytic paste as known in medical electrode appliance art.

The capacitive link is most preferably exploited for transmitting digital signals $S_{\#}$. Without having to recur to relatively complicated chart amplifier circuitry and dependent on the input impedance $Z_i$ of the unit 27 the capacitance C acts as a voltage-differentiating element, so that digital signals $S_{\#}$ will be differentiated to impulses I which may easily be detected at the unit 27. In a preferred mode this capacitive connection is used to transmit controlled signals and especially digitally controlled signal traits.

Figure 5A:
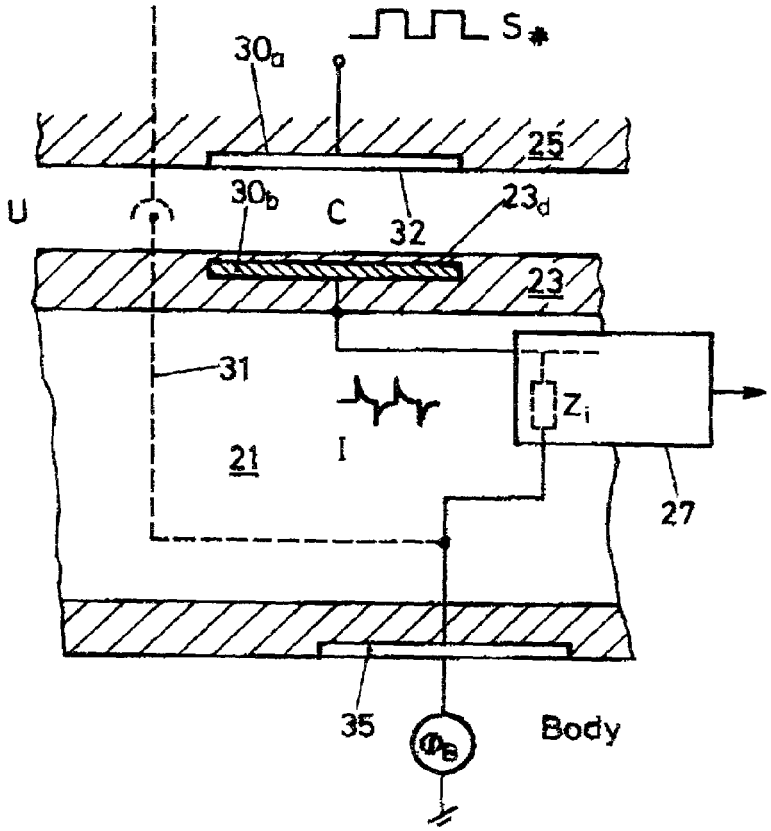
FIGS. 5A and 5B schematically the principal of the method of capacitively electrically linking as realized at a further embodiment of a hearing aid apparatus according to the present invention.
Figure 5B:
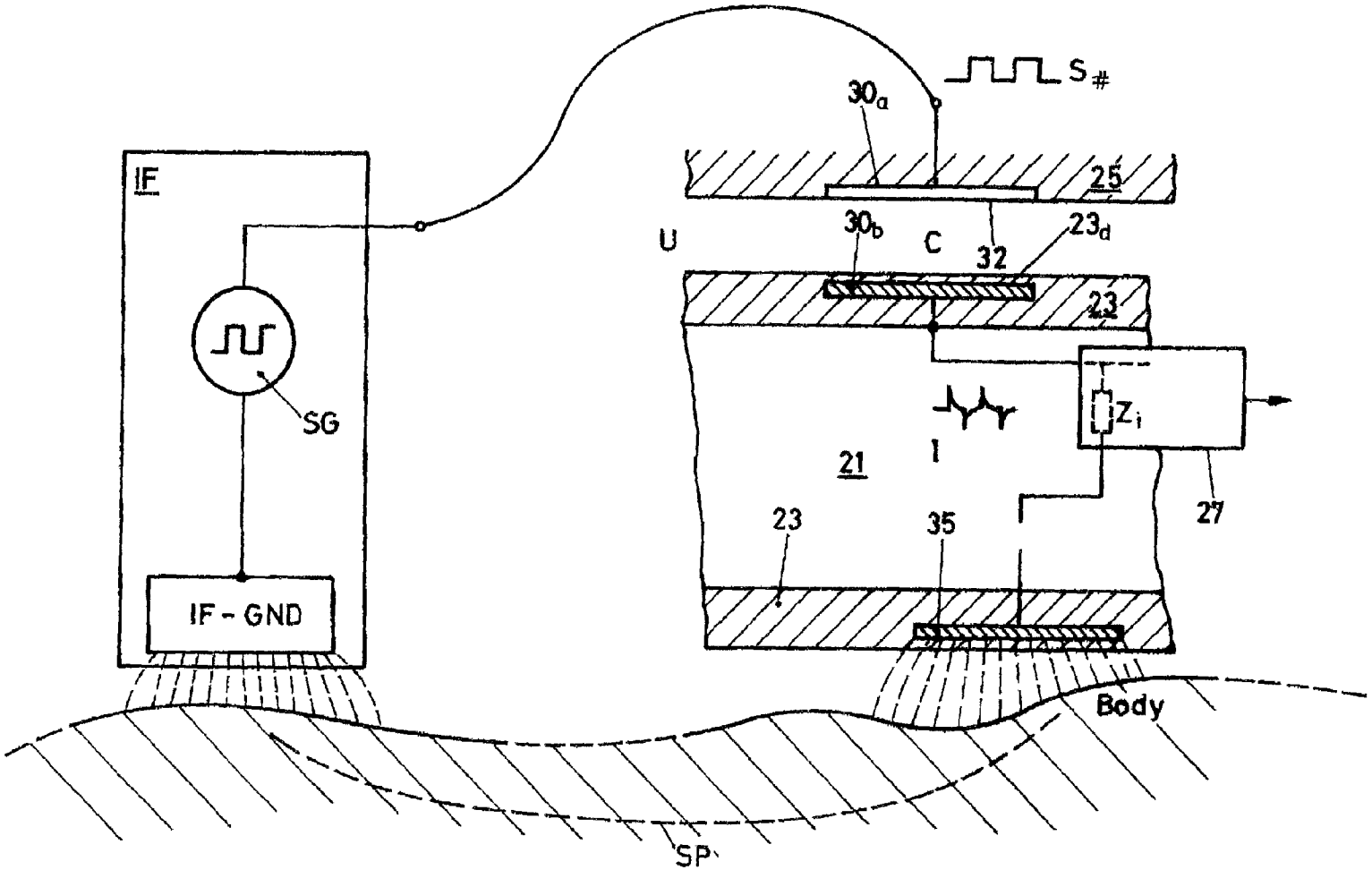

In FIG. 5B there is again schematically shown the principle of establishing an electric connection according to the present invention. In contrast to the embodiment shown in FIG. 5A the electrode 35, being the body-contacting electrode according to FIG. 5A, is embedded into the casing 23 which means that the body is also contacted by a capacitive electric coupling as it is the case between the first electrode $\mathbf{30}_a$ of the part 25 and the second electrode $\mathbf{30}_b$ of the casing 23. Furthermore, FIG. 5B shows an interface module IF in which desired signals can be generated by a signal generator SG. The signal generator SG is connected, on the one hand, to the first electrode $\mathbf{30}_a$ of the part 25 and, on the other hand, to a ground electrode IF_GND which is preferably incorporated into the interface module IF. In other words, there is provided a further capacitive electric coupling to the body to close the electric circuit.

Instead of completely incorporating the ground electrode IF_GND into the casing of the interface module IF resulting in said further capacitive electric coupling one might also provide a ground electrode which is in direct contact with the body similiarly to the arrangement of FIG. 5A where the electrode 35 is directly contacting the body.

Figure 6:
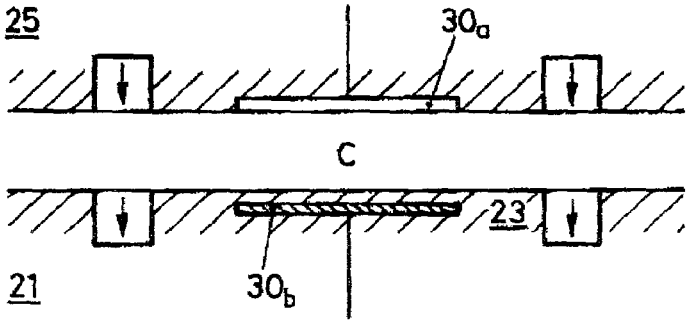
FIG. 6 still schematically the combination of series capacitance electrical linking and of magneto/mechanical linking as realized in a hearing aid apparatus according to the present invention.

As shown in FIG. 6 such series capacitance coupling by means of series capacitance element C may easily and most advantageously be combined with the magneto/mechanical linking technique as was described with the help of FIGS. of 1 to 4.

Figure 7:
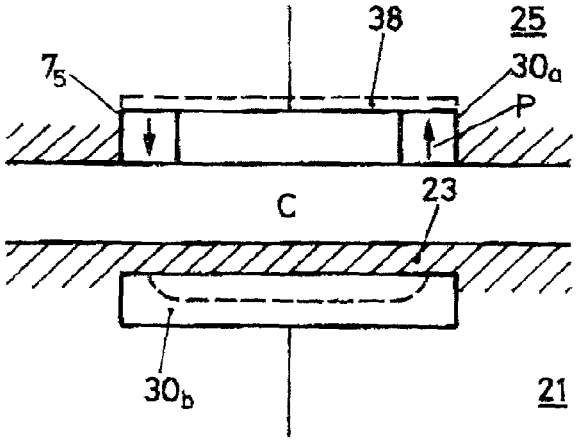
FIG. 7 a further embodiment of combined magneto/mechanical and series capacitance linking according to the method and hearing aid apparatus of the present invention.

It is even possible, as shown in FIG. 7, to use one of the two electrodes $\mathbf{30}_a$ or $\mathbf{30}_b$ or even both these electrodes as magnet arrangement, because the magnetic field generated by the magnet arrangements will not interfere with the capacitive electric coupling. As shown in FIG. 7, the electrode arrangement $\mathbf{30}_a$ at part 25 comprises the magnets of the magnet arrangement $\mathbf{7}_5$. At part 21 the counter electrode $\mathbf{30}_b$ is formed of ferromagnetic material. Thus, when approaching the two parts 25 and 21, the two electrodes $\mathbf{30}_a$ and $\mathbf{30}_b$ will be attracted snugly towards each other with dielectricum layer 23 embedded therebetween, and the magnet arrangement $\mathbf{7}_5$ with the polarities P as shown in FIG. 7 will generate the magnetic field through electrode $\mathbf{30}_b$ acting as a pole piece.

An additional pole piece 38 may be applied at part 25 to complete the magnetic circuit. Nevertheless, the magnetic field and the ferromagnetic material of the electrode $\mathbf{30}_b$ will by no means interfere with the capacitive coupling, because with respect to the material of the electrode $\mathbf{30}_b$ there is not requested a high electro conductivity. Thus, the principle of series capacitance signal transmission and of magneto/mechanical linking may be ideally combined, thereby exploiting the electrode for the capacitance coupling simultaneously as part of the magnetic link arrangement. This is much more critical with an inductive coupling, as its magnetic field may clearly interfere with inductive transmission.

Figure 8:
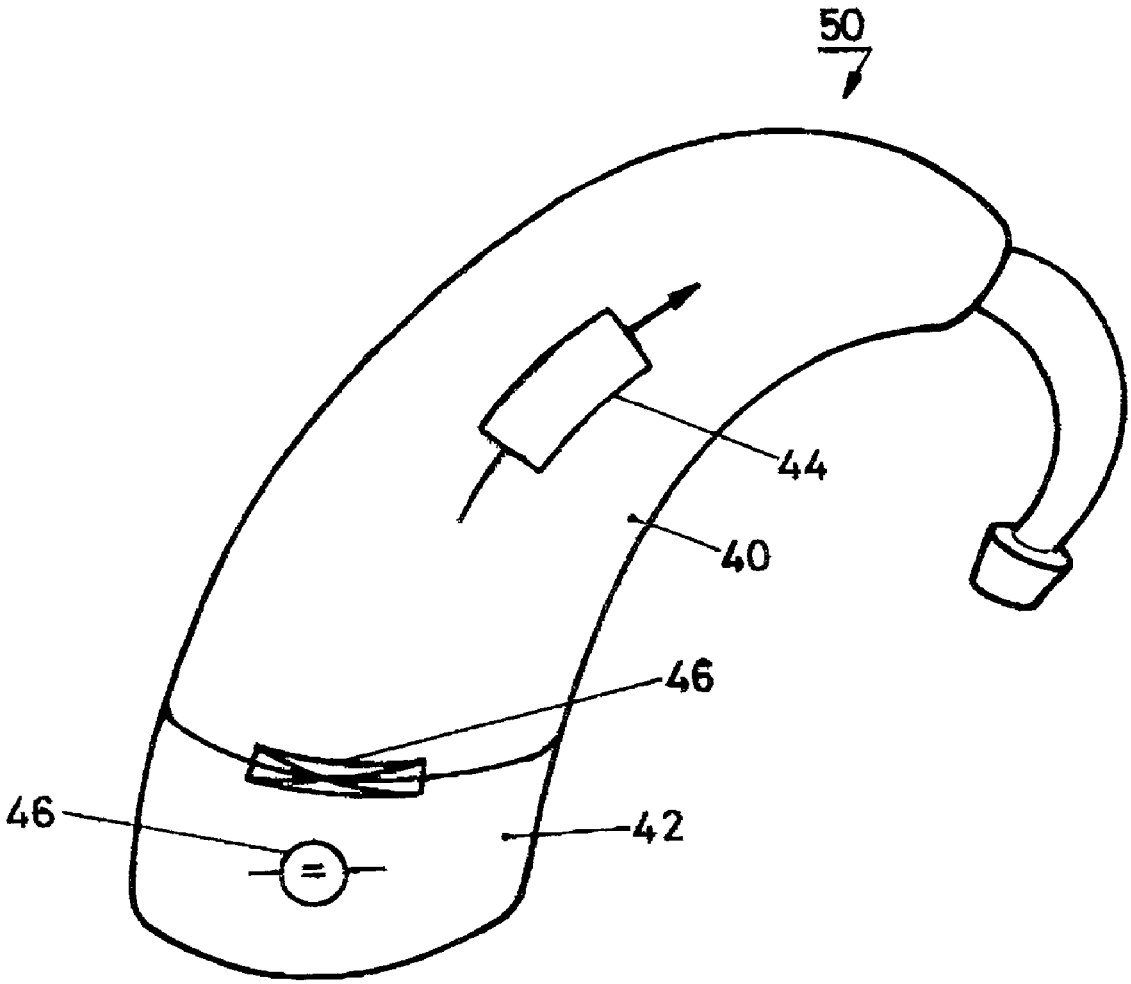
FIG. 8 schematically an inventive hearing aid apparatus, whereat two modules are linked magneto/mechanically and/or by series capacitance electric linking according to the present invention, and FIG. 9 a preferred embodiment of the present invention according to which an external appliance as of a preferably one-lead cable is temporarily applied to a hearing aid apparatus to connect latter to a Bluetooth device and/or a player device and/or a control device and/or a hearing aid DSP programming unit.

As schematically shown in FIG. 8, the magneto/mechanical link and/or the series capacitance electric link may be applied between modules 40 and 42 concomitantly forming a hearing aid apparatus 50, one module, e.g. module 40, comprising electronic circuitry 44 to be e.g. electrically supplied by means of a battery or accumulator 46 within module 42.

Module 42 may thereby be a battery or accumulator module, an emitter and/or receiver module, a filter module, a microphone module. The electric and/or mechanical link as is applied between the two modules 40 and 42 and as was explained by FIGS. 1 to 7 is denoted in FIG. 8 schematically at 46.

Figure 9:
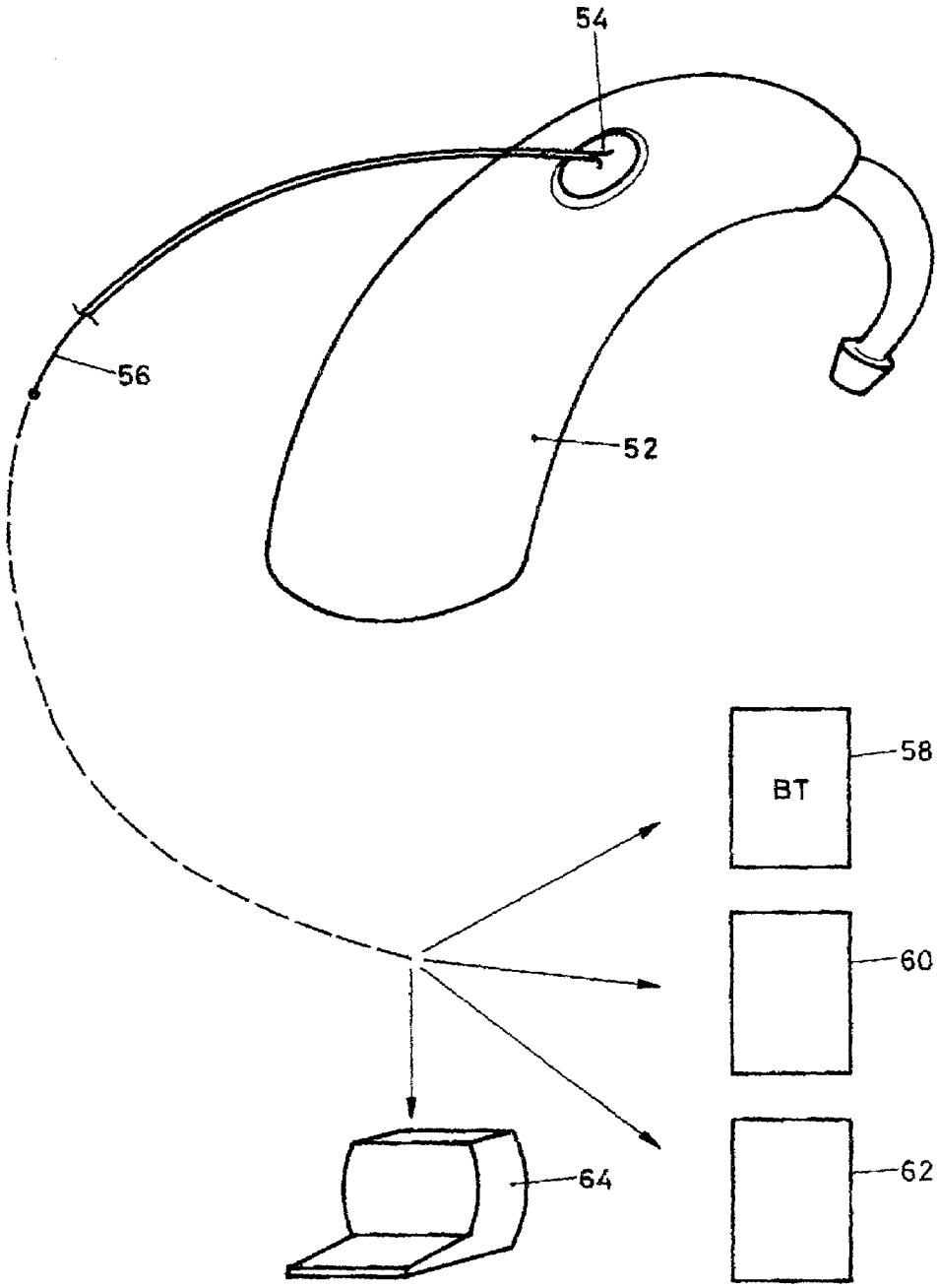

In an especially preferred mode of realization and according to FIG. 9 the magneto/mechanical link and thereby preferably combined with the series capacitance electrical link is applied between a hearing aid apparatus 52 and an external appliance, especially a cable connector 54, thereby especially preferred with a one-lead 56 cable. Looking back on FIG. 5A it is only then when part 25 does not provide for a second lead with reference potential that the body contact electrode 35 is to be provided. It is clear that reference potential may also be provided to unit 27 by galvanic contact to a reference potential lead, as shown in FIG. 5A in dashed lines and at reference number 31.

Back to FIG. 9 the preferably one-lead connection 56 may establish connection of the hearing apparatus 52 to a Bluetooth device 58 and/or to a player unit 60, e.g. a minidisk, CD or MP3 player, or to a remote control unit 62 or, and especially, to a programming unit 64 for programming the digital signal processing in the hearing aid, e.g. at the audiologist.

It is pointed out that the battery or accumulator module incorporated into the hearing aid apparatus can be used as electrode, be it the second electrode, be it the body-contacting electrode, to perform capacitive electric coupling. Furthermore, provided that the casing of the battery or accumulator module is made of a ferromagnetic material, this module may also be used to establish the mechanical link.

The invention claimed is:

1. A hearing apparatus with a detachable electric connection, said connection comprising a capacitance, a part of a casing of said hearing apparatus forming a dielectricum of said capacitance, and further comprising one conductive plate of said capacitance in contact with said part, a thickness of said part contacting said plate being smaller than a thickness of said part adjacent said plate.

2. The apparatus of claim 1, wherein said part is of a material which is equal to a material of said casing adjacent said part.

3. The apparatus of claim 1, wherein said electric connection is a connection to the outside of said hearing apparatus.

4. The apparatus of claim 3, wherein said electric connection is a connection to one of a cable and of a body of an individual carrying said apparatus.

5. The apparatus of claim 4, wherein said cable is a one-lead cable.

6. The apparatus of claim 1, wherein said electrical connection is operationally connected to an optical cable.

7. The apparatus of claim 1, wherein said electric connection is detachably held together by means of cooperating magnetic parts.

8. The apparatus of claim 7, further comprising guiding members ensuring proper alignment of said capacitance when establishing said electric connection.

9. The apparatus of claim 1, wherein said part forming said dielectricum has a surface exposed to ambient whenever said detachable electric connection is detached.

10. The apparatus of claim 9, wherein said surface of said part is flush with an outer surface of said casing adjacent said part.

11. The apparatus of claim 1, wherein said apparatus comprises a contact electrode exposed to ambient at an area of said hearing apparatus contacting a human body when carried by an individual and wherein said electrode is a reference potential electrode for electronics of said hearing apparatus.

12. The apparatus according to claim 1, wherein said detachable connection establishes an electric connection to a one-lead cable connectable to a second hearing apparatus and wherein there is provided at said one apparatus a reference potential electrode at an outer surface of said casing contacting a human body.

13. The apparatus of claim 12, wherein said reference potential electrode comprises a capacitance plate, a dielectrical material covering said plate and having a surface exposed to ambient.

14. The apparatus of claim 1 being a hearing aid apparatus.

15. The apparatus of claim 1 being an outside-the-ear or an inside-the-ear hearing apparatus.

16. The apparatus of claim 1, further comprising a remote transmitter module operationally connectable to said hearing apparatus via said detachable connection.

17. The apparatus of claim 1, further comprising a remote control unit for said hearing apparatus being connectable to said hearing apparatus via said detachable connection.

18. The apparatus of claim 1, further comprising a second hearing apparatus, said one and said second apparatus being interconnected via said detachable connection.

* * * * *